US005181548A

United States Patent [19]

Matthews

[11] Patent Number: 5,181,548

[45] Date of Patent: Jan. 26, 1993

[54] EMERGENCY EXIT SECURITY WINDOW BLINDS

[76] Inventor: Arthur J. Matthews, 631 Columbia Ave., Atco, N.J. 08004

[21] Appl. No.: 566,067

[22] Filed: Aug. 13, 1990

Related U.S. Application Data

[63] Continuation-in-part of Ser. No. 523,200, Apr. 2, 1990, which is a continuation-in-part of Ser. No. 419,460, Oct. 10, 1989, abandoned.

[51] Int. Cl.[5] ..... E06B 9/30

[52] U.S. Cl. ..... 160/172; 160/201

[58] Field of Search ..... 160/172, 201, 117, 168.1, 160/176.1, 178.1, 169

[56] References Cited

U.S. PATENT DOCUMENTS 2,299,095 10/1942 Knox ..... 160/172
2,523,392 9/1950 Rabinowitz et al. ..... 160/172
2,577,884 12/1951 Garubo ..... 160/172
3,658,112 4/1972 Imaizumi ..... 160/172
3,853,169 12/1974 Music et al. ..... 160/172
4,556,095 12/1985 Lewis ..... 160/172 X

*Primary Examiner*—Blair M. Johnson
*Attorney, Agent, or Firm*—Abdallah & Muckelroy

[57] ABSTRACT

A decorative venetian blind window security system that can be readily removed for emergency exit is disclosed. The security system includes a plurality of blind slats disposed within a frame assembly that receive locking rods through elongated openings formed in the blind slats. The locking rods can be selectively locked within the blind slats from the inside of the frame assembly. The blind slats can be selectively locked against rotational and transverse movement by locking means attached to the frame assembly.

10 Claims, 3 Drawing Sheets

EMERGENCY EXIT SECURITY WINDOW BLINDS

This application is a continuation-in-part of U.S. Ser. No. 523,200, filed Apr. 2, 1990, which is a continuation-in-part of U.S. Ser. No. 419,460, filed Oct. 10, 1989now abandoned, and entitled "Security Window Blinds." U.S. Ser. No. 523,200 is incorporated herein by reference.

BACKGROUND OF THE INVENTION

The present invention generally relates to security systems for windows. More particularly, this invention relates to secured window blinds that can be readily removed for emergency exit.

Burglary is a growing threat to homeowners and windows are a primary point of forced entry. Random burglaries are often committed by juveniles who principally choose a target based on the amount of resistance encountered. If a home, office, store or warehouse is equipped with a window security system, the juvenile burglar will likely move on to a easier target. While the present invention will not always prevent burglary by a professional, it is particularly effective against random, juvenile burglars.

Window security systems known in the prior art are generally either permanently attached to the window, or are provided with locking means that prevent the window system from being easily removed. While such window security systems deter some burglaries, they otherwise create a hazard for the inhabitants of the home, office and the like who need to exit a window during an emergency, such as during a fire. Permanently attached window security systems obviously provide no escape. The opening of a window security system that is provided with locking means may be difficult to operate or access in an emergency, or the key may be lost from the system.

A commonly-known window security system is an array of bars disposed to the outside of a window. The bars may be permanently attached about the window or selectively lockable. In U.S. Pat. No. 1,302,093 to Shomaker a window security system is shown wherein a safety shutter is disclosed having shutter slats that abut guides mounted in a shutter frame to render the slats immovable. U.S. Pat. No. 3,853,169 to Music et al. discloses a shutter blind unit wherein the shutters are prevented from being moved vertically by locking means which engage the axis of the shutters within the unit frame. A security shutter is also disclosed in U.S. Pat. No. 4,431,044 to Bruneau wherein articulated shutters are lockable by engagement of the shutters with brackets formed in the shutter frame.

In addition to not being easily removable for emergency exit, the window security systems of the prior art generally are not useful as decorative window garments. Furthermore, the prior art window security systems are generally complicated, multi-component structures which result in expensive and commercially unmarketable window security systems.

SUMMARY OF THE INVENTION

The window security system of the present invention comprises a venetian blind assembly generally including, in combination, a rectangular assembly frame; a plurality of blind slats attached at their respective ends in rotatable and slidable engagement to top and bottom portions of said assembly frame, said blind slats having one or a plurality of oval apertures formed therein in parallel alignment with said top and bottom portions of said assembly frame; one or a plurality of locking rods receivable within the apertures of said blind slats; and blind slat locking means which prevent rotatable and slidable movement of said blind slats within said assembly frame. The locking rods are selectively receivable in apertures of the blind slats and are protected against unauthorized removal therefrom by a rod access door selectively lockable and hingedly attached to the assembly frame.

An object of this invention is to provide a window security system that is both burglar-resistant and decorative.

Another object of the present invention is to provide a window security system that is simple to construct.

It is also an object of this invention to provide a window security system that can be quickly and easily removed for emergency exit.

These and other objects and advantages of the present invention will be apparent to those skilled in the art from the following description of a preferred embodiment, claims and appended drawings.

DESCRIPTION OF A PREFERRED EMBODIMENT

Figure 1:
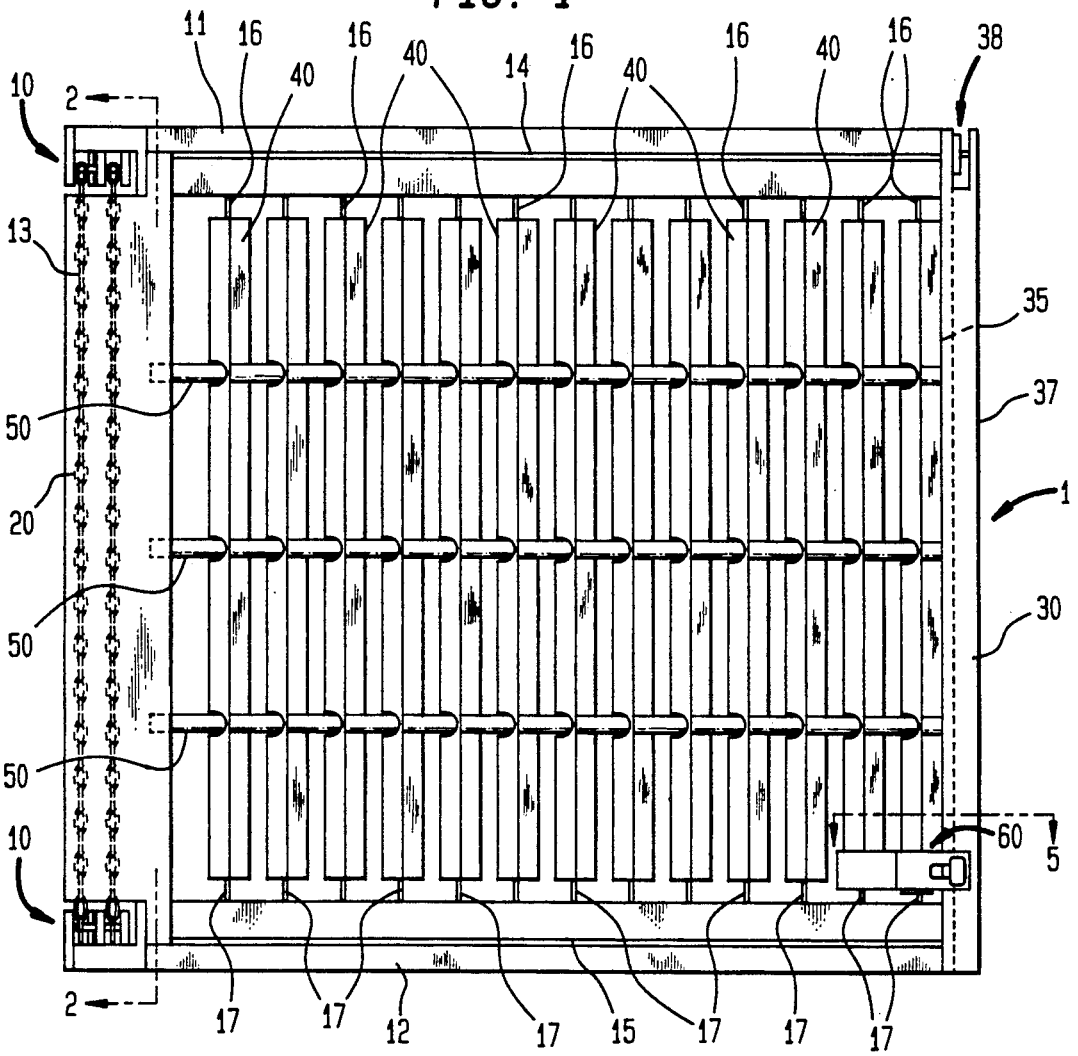
FIG. 1 is a plan view of the venetian blind window security system of the present invention shown with the blind slats disposed in their open position.

FIG. 1 illustrates in a front plan view a preferred embodiment of the window security system 1 of the present invention. Window security system 1 generally comprises, in combination, a synchronized top and bottom track system as generally indicated by the numeral 10, a first side frame member 20, a second side frame member 30, a plurality of blind slats 40, a plurality of locking bars 50 and blind slat and rod door locking means 60.

The top and bottom track system 10 includes a top carrier truck 11, a bottom carrier truck 12 and an endless-bead-chain rotation and traversing control mechanism 13. The control mechanism 13 is disposed within said first side frame member 20 and communicates with said top carrier truck 11 and said bottom carrier truck 12 for selective, synchronized rotation and transverse movement of the blind slats 40 within the respective trucks 11, 12. An exemplary top and bottom track system 10 is manufactured by Profile Corporation of Ft. Lauderdale, Fla.

The respective carrier trucks 11, 12 of the top and bottom track system 10 have horizontal slots 14, 15 extending for the length of the trucks 11, 12 on each of the respective forward and rearward walls of the trucks 11, 12. The first side frame member 20 and the second side frame member 30 engage the respective slots 14, 15 of the carrier trucks 11, 12 at first and second ends thereof as hereinafter described in greater detail.

Figure 2:
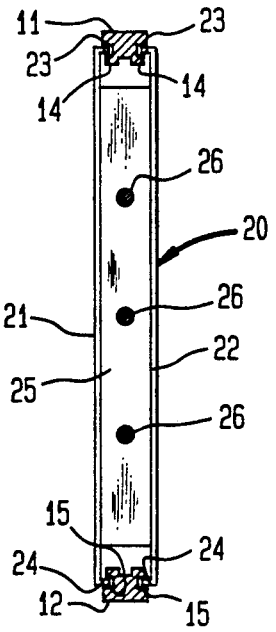
FIG. 2 is a side plan view taken along line 2—2 of FIG. 1.

Referring now to FIG. 2 there is shown a side plan view of the first side frame member 20 as taken along line 2—2 of FIG. 1. First side frame member 20 is substantially an elongated rectangular polyhedron having its forward and rearward walls 21, 22 preferably formed from sheet metal or other pliable material. The forward and rearward walls 21, 22 have inwardly-extending truck engagement tabs 23, 24 formed at the respective top and bottom ends of the first side frame member 20 which engage the slots 14 and 15 of the respective top and bottom carrier trucks 11, 12 for attachment of the first side frame member 20 to the top carrier truck 11 and to the bottom carrier truck 12. First side frame member 20 further includes a first frame plate 25 disposed in the interior cavity of the first side frame member 20 that includes a plurality of holes or slots 26 formed therein which receive the ends of the locking rods 50 of the present invention. The forward wall 21 of the first side frame member 20 preferably includes top and bottom cutaway portions (FIG. 1) to permit physical access to the rotation and traversing control mechanism 13 of the top and bottom track system 10 for cleaning, maintenance, etc.

Figure 3:
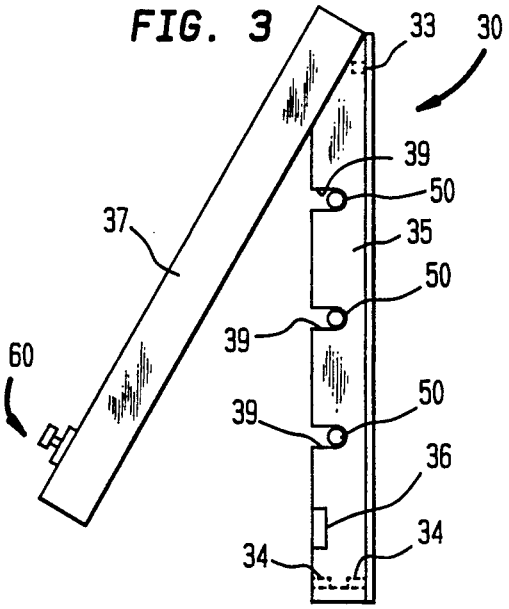
FIG. 3 is an end plan view of the second side frame member shown having the door thereof disposed in its open position

FIG. 3 illustrates an end plan view of the second side frame member 30. Second side frame member 30 includes a second frame plate 35 and a rod locking door 37 hingedly attached to said second frame plate 35 by door hinge means 38 (FIG. 1). Second frame plate 35 includes a plurality of frame plate end slots 39 which extend to one side of said second frame plate 35 and receive the locking rods 50 as hereinafter described in greater detail. Rod locking door 37 is disposed to rotate outwardly toward the front of the system 1. Inwardly-extending truck engagement tabs 33, 34 are formed at the respective top and bottom ends of the second frame plate 35. Said engagement tabs 33, 34 engage the slots 14 and 15 of the respective top and bottom carrier trucks 11, 12 for attachment of the second side frame member 30 to the top carrier truck 11 and the bottom carrier truck 12. The blind slat and rod door locking means 60 of the present invention is attached to the rod locking door 37 and selectively engages a threaded locking means engagement tab 36 fixedly attached to said second frame plate 35 and extending transversely therefrom to lock the blind slats 40 and said rod locking door 37 as hereinafter described in greater detail. Rod locking door 37 is preferably formed from sheet metal or other pliable material.

Figure 4:
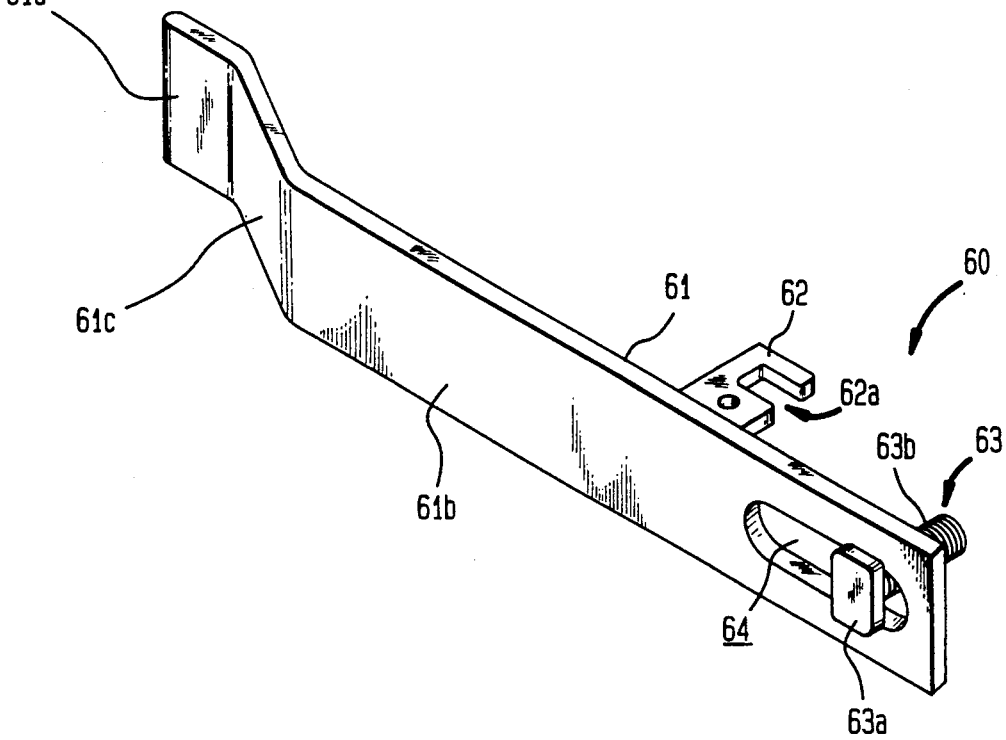
FIG. 4 is a perspective view of the blind slat and rod door locking means of the present invention.
Figure 5:
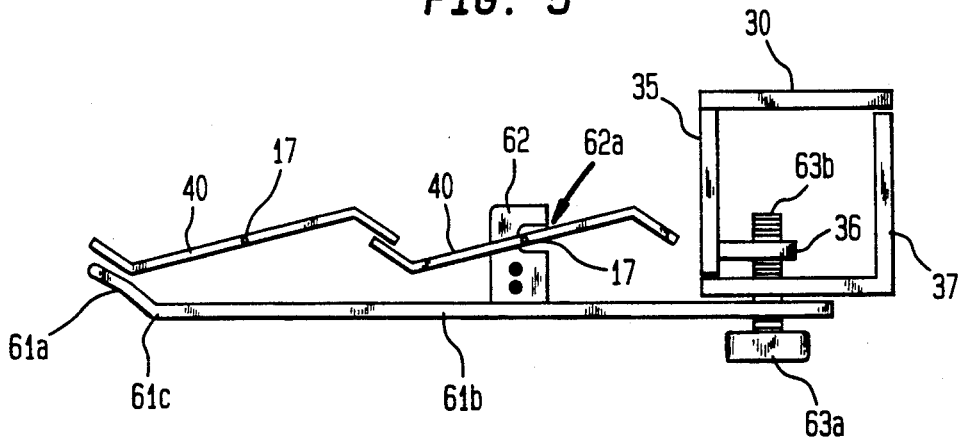
FIG. 5 is a top plan view taken along line 5—5 of FIG. 1 shown with the blind slats disposed in their closed and locked position.

FIG. 4 illustrates an enlarged perspective view of the blind slat and rod door locking means 60 of the present invention. Blind slat and rod door locking means 60 generally comprises a substantially Z-shaped blind slat locking bar 61 having a first locking bar leg 61*a*, a second locking bar leg 61*b* and a locking bar central portion 61*c*; a blind slat locking hook 62 fixedly attached adjacent to a side wall of the second locking bar leg 61*b* of said locking bar 61 adjacent the juncture of said second locking bar leg 61*b* and said locking bar central portion 61*c* and extending transversely therefrom, and a locking key 63 slidably disposed in a locking key slot 64 formed proximate to the end of said second locking bar leg 61*b*. FIG. As can be seen in the top plan view of the blind slat locking means 60 illustrated in FIG. 5 shown with the blind slats 40 disposed in their closed position the first locking bar leg 61*a* of said locking bar 61 bears against the end of a blind slat 40 and thereby prevents rotatable movement of said blind slat 40. Since movement of the plurality of blind slats 40 is synchronized, preventing one blind slat 40 from rotating prevents rotation of the plurality of blind slats 40. For additional security, the first locking bar leg 61*a* of said locking bar 61 may alternatively be formed of sufficient length to extend in bearing engagement across a plurality of blind slats 40.

Locking hook 62 is formed having a hook slot 62*a* which engages a lower slat support hook 17 (FIG. 1) to prevent transverse movement of said blind slats 40. A plurality of blind slat locking hooks 62 may be attached to the second locking bar leg 61*b* to engage a plurality of lower slat support hooks 17 without departing from the spirit and scope of the present invention. Locking key 63 includes a locking key head 63*a* and a threaded locking key stem 63*b*. Said locking key stem 63*b* extends through the locking key slot 64 of said blind slat locking bar 61 and a threaded opening 37*a* in said rod locking door to threadedly engage said locking means engagement tab 36.

Figure 6:
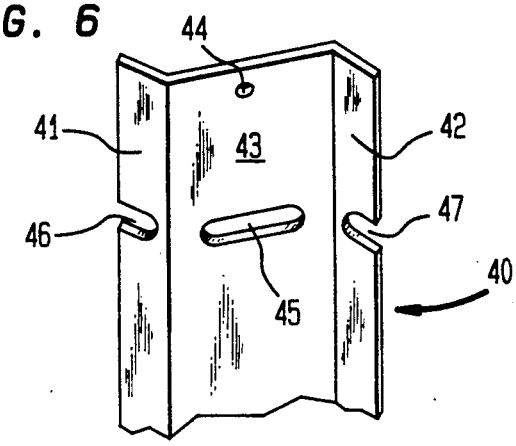
FIG. 6 is a partially fragmented perspective view of a blind slat of the present invention.

Referring now to FIG. 6 there is shown a fragmented perspective view of an end of blind slat 40 which is typical of both ends of said blind slat 40. Blind slat 40 is a substantially Z-shaped plate member having a first end portion 41, a second end portion 42 and a central portion 43. End apertures 44 are formed in the central portion 43 of the blind slat 40 at the respective ends thereof, and one or a plurality of transversely-elongated slots 45 are disposed in said central portion 43 between said end apertures 44. Paired notches 46, 47 are formed in the respective first and second end portions 41, 42 of the Z-shaped blind slat 40 in transverse alignment with respective elongated slots 45. The end apertures 44 provide means for engagement of the upper and lower slat support hooks 16, 17 of the respective carrier trucks 11, 12 of the top and bottom track system 10 (FIG. 1). The elongated slots 45 in combination with the paired notches 46, 47 provide means for the blind slats 40 to be rotated with the locking rods 50 disposed within the slats 40.

Figure 7:
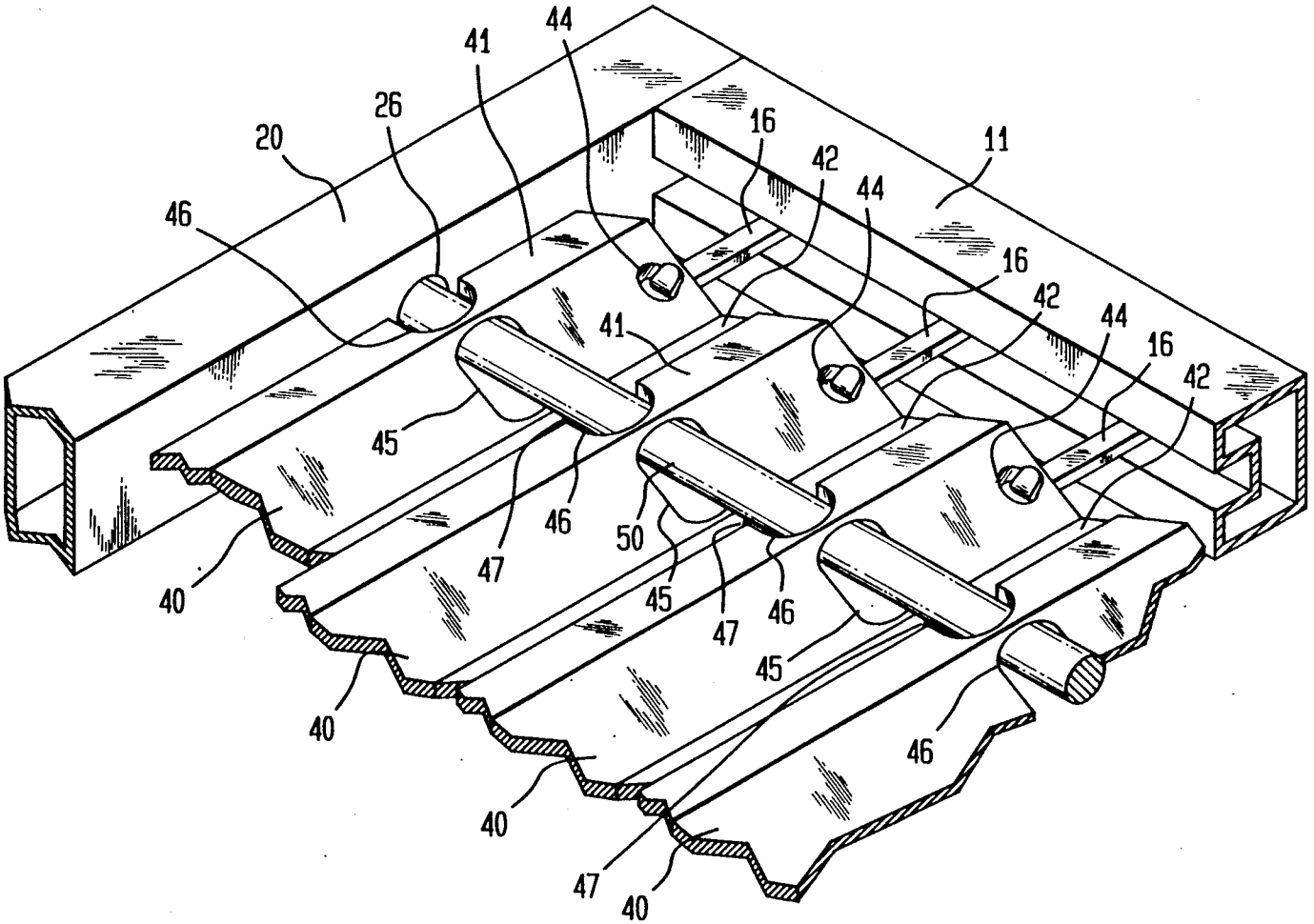
FIG. 7 is a partially fragmented perspective view of the security system of the present invention shown with the blind slats disposed in their closed position.

Reference is now made to FIG. 7 wherein there is illustrated in a fragmented perspective view the disposition of the blind slats 40 when the system 1 is closed. In the closed position the first end portion 41 of a blind slat 40 overlaps the second end portion 42 of an adjacently disposed blind slat 40. Locking rod 50 extends through the elongated slots 45 of the several blind slats 40, the paired notches 46 and 47 being brought into bearing engagement with the locking rod 50. Overlapping engagement of the end portions 41, 42 of adjacently disposed blind slats 40 forms a solid wall to resist attempts at forced entry. The locking rod or rods 50 resist any lateral displacement of the blind slats 40 to maintain the blind slats 40 in a substantially close interlocking engagement.

The blind slats 40 are prevented from rotational and transverse movement within the top and bottom track system 10 by operation of the blind slat and rod door locking means 60. As previously noted, the window security system 1 of the present invention is useful as a window garment and as a deterrent to burglary. As a window garment the system 1 can be utilized without the locking bars 50. Blind slat locking bar 61 may hang loosely attached to rod locking door 37 or may be secured thereto by threaded engagement of the locking key stem 63*b* in the threaded opening 37*a* of the rod locking door 37. The blind slats 50 can be selectively rotated and moved transversely within the top and bottom track system 10 by operation of the endless-bead-chain control mechanism 13. To secure a window, door or other opening the locking rods 50 are inserted from the second side frame member 30 through the elongated slots 45 to the slots 36 formed in the first side frame member 20. The ends of the locking rods 50 adjacent to the second side frame member 30 are placed into the frame plate end slots 39 of the second frame plate 35 in said second side frame member 30. The blind slats 40 are then turned to their closed positions until the respective first end portions 41 and second end portions 42 of said blind slats 40 overlap having the paired notches 46, 47 engaging said locking rods 50. The locking rods 50 and blind slats 40 are then locked by operation of the blind slat and rod door locking means 60.

The locking key head 63*a* is rotated by hand operation to loosen the blind slat locking bar 61. The first locking bar leg 61*a* is brought into bearing engagement with the overlapping end portions 41, 42 of blind slats 40. The hook slot 62*a* of the blind slat locking hook 62 is brought into hooking engagement with a lower slat support hook 17. The locking key slot 64 in the second locking bar leg 61*b* permits the blind slat locking bar 61 to be moved back and forth for minor adjustments. When the locking bar 61 is positioned as described it is locked in place by tightening the stem 63*b* of locking key 63 in the locking means engagement tab 36. Thereby the rod locking door 37 is fastened to prevent unauthorized removal of locking rods 50 from the blind slats 40 and the blind slats 40 are braced against lateral displacement by the locking rods 50. Furthermore, the blind slats 40 are locked against rotation by the bearing engagement of the first locking bar leg 61*b* and against transverse movement by the hooking engagement of the locking hook 62.

For emergency exit the locking key head 63*a* is loosened by hand operation to release the blind slat locking bar 61 and blind slat locking hook 62 from the blind slats 40. Blind slats 40 are then turned to the open position and moved toward the first side frame member 20. The rod locking door 37 is rotated forwardly permitting the locking rods 50 to be removed forward from the frame plate end slots 39 and then slidably out of the slots 45 of the blind slats 40.

Other changes, modifications, and additions can be made to the present invention without departing from the spirit and scope of the present disclosure. Such changes, modifications and the like are intended to be disclosed from a reading of the appended claims.

Therefore, in view of the foregoing I claim:

1. A window security system comprising, in combination a system frame assembly, said frame assembly comprising an upper frame member, a lower frame member, a first side frame member and a second side frame member, said upper frame member and said lower frame member being disposed in parallel alignment with each other and including means for rotatably receipt of a plurality of blind slats disposed therebetween, said first side frame member being attached at one end of the respective upper and lower frame members, said second side frame member being attached at the opposite end of the respective upper and lower frame member, said first side frame member including one or a plurality of slots for respective receipt of a locking rod, said second side frame member including one or a plurality of holes for respective receipt of said locking rod, said second side frame member further including means to selectively retain said one or a plurality of locking rods within said first side frame member and said second side frame member;

a plurality of blind slats attached to said means for rotatable receipt included in said upper and lower frame members, said blind slats having a plurality of slots formed therein in parallel alignment with said upper and lower frame members suitable for receipt of a locking rod, said plurality of slots being formed in a manner to permit said blind slats to be rotated into interlocking engagement having said locking rod received therein; and a plurality of locking rods of sufficient length and size to extend between the slots of said first side frame member and the holes of said second side frame member through the apertures of said blind slats.

2. A window security system comprising, in combination an assembly frame comprising a synchronized top and bottom track system, a first side frame member attached to one end of said track system and a second side frame member attached to the opposite end of said track system;

a plurality of interlocking blind slats attached at their respective ends in rotatable and transversely slidable engagement with said top and bottom track system, said blind slats having apertures formed therein for receipt of a locking rod in aligned apertures of respective blind slats; and one or a plurality of locking rods receivable within the apertures of said blind slats, said locking rods being of sufficient length to extend between said first side frame member and said second side frame member, said locking rods being selectively removable from said blind slats by locking means disposed in said assembly frame.

3. A window security system as described in claim 2 wherein said first side frame member is a quadrilateral member having a first frame plate disposed in the interior cavity of said first side frame member, said first frame plate having a plurality of slots formed therein for receipt of an end of said locking rods.

4. A window security system as described in claim 3 wherein said second side frame member is a quadrilateral member having a second frame plate disposed at the inwardly-oriented side of said second side frame member and a hingedly attached door disposed at the outwardly-oriented side of said second side frame member, said second frame plate having a plurality of holes formed therein for receipt of said locking rods, said second side frame member and door including selectively operable door locking means attached thereto.

5. A window security system as described in claim 4 wherein said door locking means includes a hook catch fixedly attached to said door and a rotatable locking hook disposed in said second side frame member which selectively engages said hook catch, said locking hook being operable by means of a hook knob disposed on an outwardly disposed face of said second side frame member.

6. A window security system as described in claim 5 wherein said blind slats are substantially Z-shaped plate members having end apertures formed in the central portion of respective slats at each end thereof, one or a plurality of transversely-elongated slots disposed in the central portion of said slats between said end apertures, and paired notches formed in the respective end portions of said slats in transverse alignment with said elongated slots.

7. A window security system as described in claim 6 wherein said blind slats are disposed within said assembly frame to permit an end portion of one blind slat to overlap in interlocking engagement with the opposing end portion of an adjacently disposed blind slat when said blind slats are rotated to their closed position.

8. A window security system as described in claim 7 wherein said locking rod comprises an elongated bar member having a locking rod head formed at one end of said bar member.

9. A window security system as described in claim 2 wherein said blind slats are selectively lockable against rotatable movement.

10. A window security system as described in claim 2 wherein said blind slats are selectively lockable against transverse movement

* * * * *